United States Patent [19]

Gleisten

[11] Patent Number: 4,775,129

[45] Date of Patent: Oct. 4, 1988

[54] WALL HANGER

[76] Inventor: John A. Gleisten, 3727 Dove St., San Diego, Calif. 92103

[21] Appl. No.: 17,877

[22] Filed: Feb. 24, 1987

[51] Int. Cl.[4] ..... A47G 1/16

[52] U.S. Cl. ..... 248/493; 248/496; 248/498

[58] Field of Search ..... 248/476, 477, 489, 493, 248/494, 495, 496, 497, 498, 300; 40/152.1, 153

[56] References Cited

U.S. PATENT DOCUMENTS

| | | | |
|---|---|---|---|
| 366,812 | 7/1887 | Brinkerhoff | 248/493 |
| 406,623 | 7/1889 | Brinkerhoff | 248/493 |
| 814,163 | 3/1906 | Pursell | 248/498 |
| 1,600,919 | 9/1926 | Baalsrud | 248/496 |
| 2,099,332 | 11/1937 | Nuccio | 248/498 |
| 2,137,837 | 11/1938 | Freudenberger | 248/493 |
| 2,180,211 | 11/1939 | Kellogg | 248/493 |
| 2,483,114 | 9/1949 | Van Schoor | 248/496 |
| 2,495,477 | 1/1950 | Raitt | 248/493 |
| 2,495,712 | 1/1950 | Foltis | 248/493 |
| 2,877,972 | 3/1959 | Sutton | 248/493 |
| 3,226,065 | 12/1965 | Smith | 248/493 |

FOREIGN PATENT DOCUMENTS

| | | | |
|---|---|---|---|
| 1220412 | 1/1971 | United Kingdom | 248/495 |

*Primary Examiner*—J. Franklin Foss
*Assistant Examiner*—Robert A. Olson
*Attorney, Agent, or Firm*—Ralph S. Branscomb

[57] ABSTRACT

A wall hanging fastener is provided which is universally applicable in that it can be nailed to the frame of a wall hanging and placed with a serrated edge on a wall nail, or it can be hooked on a wall nail, or in its preferred mode, the wall hanging has a hanging wire which is entrained through special slots in the fastener, and the fastener is slipped over a wall nail. When used according to the preferred embodiment, the fastener will resist axial sliding along the wire, so that once it is centered, if it is centered properly, the painting shall remain in its proper position and will not become angled as do most hanging paintings due to being brushed or the slight jarring of the wall on which the painting is hung.

5 Claims, 1 Drawing Sheet

WALL HANGER

BACKGROUND OF THE INVENTION

Keeping paintings and other wall hangings straight on a wall is an aggravating task that has been plaguing mankind since the invention of walls and wall hangings. Especially in a place such as an office, in which there are a number of certificates and framed mementos and letters of appreciation hanging on the walls, it is almost impossible to keep all of the hangings straight and orderly-looking because, as the wall shakes due to corridor traffic, door slamming, and file cabinet shuttings, the wall hangings will almost all seek out an orientation of disarray. This is due to the fact that the hanging is not centered on the nail or wall fastener. Even if the original centering is exact, over time the hanging wire will migrate on the nail or wall fastener so that it is no longer centered, resulting in the painting becoming slanted no matter how much care was originally taken to originally center it on the wall nail.

There is a need for a hanger or fastener which will engage a wall hanging wire in such a way that migration of the fastener along the wire is eliminated. With such an item, once the hanger was centered on the wire, if the centering were properly accomplished, there would no longer be any migration and no longer a tendency for the painting to lean.

SUMMARY OF THE INVENTION

The fastener of the instant invention has a central, flared, slotted aperture which hooks over a wall nail or other fastener, and a pair of bent, laterally-extended wings, each of which has two keyhole-shaped slots, one being entrant from the top and one from the bottom, through which the wire from a wall hanging is entrained. Once the hanger is in place on the wire, the central slot is hooked over a wall nail, and because of the slight bend that the side wings create in the wire, the wire will not migrate relative to the hanger, and thus the painting or other wall hanging will not slant.

The hanger is a universal hanger in that there are several modes of use, in addition to the preferred one, which is described above. Additionally, there are nail holes in the hanger so that it can be nailed to a wall hanging frame and hooked directly onto the wall nail, bypassing the need for a hanging wire altogether. There are two modes of this direct attachment, one in which the central aperture is used to hook over a wall nail, and another in which a serrated edge is attached to the picture frame in typical fashion so that lateral adjustment is made possible in the event it is not practical to center the hanger perfectly on the frame.

DETAILED DESCRIPTION OF THE PREFERRED EMBODIMENT

Figure 1:
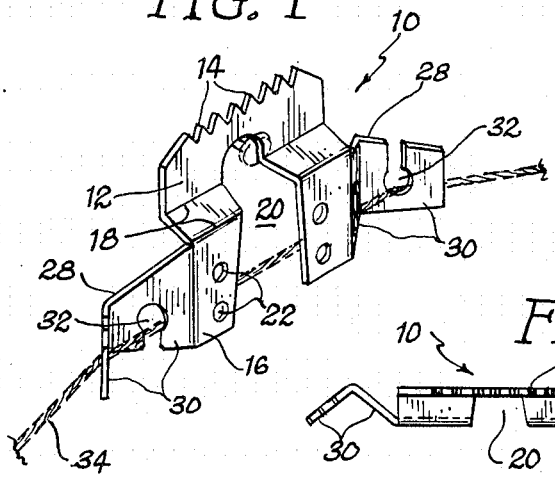
FIG. 1 is a perspective view illustrating the preferred use of the invention in which a hanging wire is threaded through the slotted openings in the body.
Figure 3:
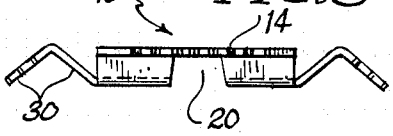
FIG. 3 is a top plan view of the hanger.
Figure 4:
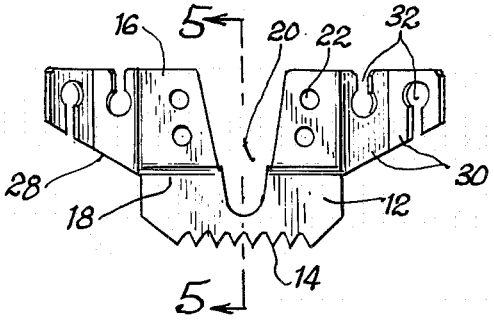
FIG. 4 is a front elevation view of the hanger illustrated in an alternative mode of attachment to a wall hanging.

The hanger is shown in its entirety in FIG. 1. It comprises a single stamping from a sheet metal blank. The body 10 has an upper portion 12 which is serrated at 14 along its edge. The lower portion 16 connects to the upper portion through two L-shaped bends 18, and the central part of the lower portion is divided by the wide, flared aperture 20, which is used in two embodiments to hook the hanger over a wall fastener or nail.

Figure 5:
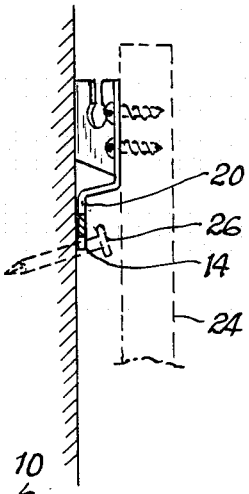
FIG. 5 is a section taken along line 5—5 of FIG. 4.
Figure 7:
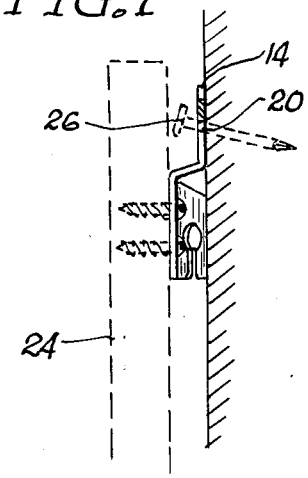
FIG. 7 is a section taken along line 7—7 of FIG. 6, illustrating a third mode of use of the invention.

Alongside the aperture are nail holes 22. The nail holes are used in the alternative embodiments to nail the hanger directly to a picture frame 24 shown in FIGS. 5 and 7. In FIG. 5, the hanger is upside down, with the serrated edge 14 being used to hook over the wall nail 26. In FIG. 7, the fastener is right-side up, and the aperture 20 is used to engage the wall nail 26.

Figure 2:
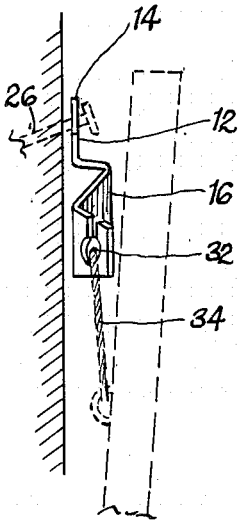
FIG. 2 is a side elevation view of the hanger in use according to the mode illustrated in FIG. 1.
Figure 6:
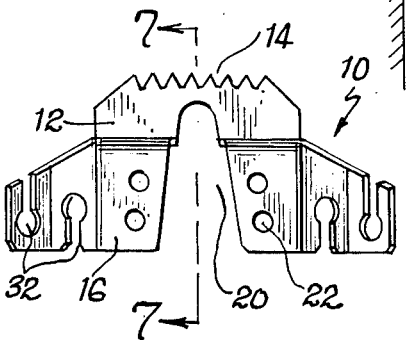
FIG. 6 is a front elevation view of the hanger.

However, both of these embodiments are not preferred, and for use in the preferred mode, the body has a pair of wings 28 that extend laterally out from the body, and are bent to define two panels 30. Each panel has a keyhole-shaped slot 32 defined in it, with the inside keyholes being entrant from the bottom and the outer keyholes being entrant from the top, as is best seen in FIG. 6. Thus, a wire 34 can be passed through the keyholes as shown in FIGS. 1 and 2. This is the preferred way of using the hanger. Once the hanger is on the wire, it can be moved axially by overcoming the friction of the wire in the keyholes, to find the centermost point along the wire. Once this point is found and the wall hanging is hung, the weight of the wall hanging on the wire will prevent the wire from mmigrating axially through the keyholes, so that if the hanger is centered properly in the first place, it will remain centered.

However, in some situations, there will be no wire available on the wall hanging, and to make the hanger universally usable, one of the first two modes of hanging can be used. Thus, irrespective of what type of frame is used, the hanger is effective. Frames all provide some means of attaching a wire, even if they are not wood, and thus would not enable the nail attachment of the instant hanger in its two alternative embodiments. It is truly a universal hanger.

I claim:

1. A hanger for a picture or like wall hanging have a hanging wire, and hanger comprising:

(a) a body;

(b) said body having a wire-engaging means configured to resist the axial migration of a wire engaged therein;

(c) said body having a fastener-engaging means to engage said body on a nail in the wall, such that said body can be engaged on the wire of a wall hanging by said wire-engaging means, and engaged on a wall by said fastener-engaging means to suspend said wall hanging from the wall;

(d) said fastener-engaging means comprising a central aperture laterally centralized in said body for engaging over a nail in the wall, and wire-engaging means comprising a first pair of slots, one on each side of said opening, and being entrant from the top to accept a wire therethrough;

(e) a second pair of slots laterally displaced from the first pair to better engage a wire passed through all of said slots, said second pair of slots being entrant from the bottom of said body to better capture a wire entrained through said slots; and, (f) said body defining a pair of laterally extended wings, and each of said wings being bent to define a pair of angled panels, and one of said slots being defined in each of said respective panels.

2. A hanger for a picture or like wall hanging have a hanging wire, said hanger comprising:

(a) a body;

(b) said body having a wire-engaging means configured to resist the axial migration of a wire engaged therein;

(c) said body having a fastener-engaging means to engage said body on a nail in the wall, such that said body can be engaged on the wire of a wall hanging by said wire-engaging means, and engaged on a wall by said fastener-engaging means to suspend said wall hanging from the wall;

(d) said fastener-engaging means comprising a central aperture laterally centralized in said body for engaging over a nail in the wall, and wire-engaging means commprising a first pair of slots, one on each side of said opening, and being entrant from the top to accept a wire therethrough;

(e) a second pair of slots laterally displaced from the first pair to better engage a wire passed through all of said slots, said second pair of slots terminating adjacent the ends of said first pair of slots such that a wire can be woven through all of said slots to increase the purchase of said hanger on said wire.

3. Structure according to claim 2 wherein said second pair of slots are entrant from the bottom of said body to better capture a wire entrained through said slots.

4. Structure according to claim 3 wherein all of said slots are keyholed shaped to positively retain a wire entrained therethrough.

5. Structure according to claim 3 wherein said body defines a pair of laterally extended wings, and each of said wings is bent to define a pair of angled panels, and one of said slots is defined in each of said respective panels.

* * * * *